US008136489B2

(12) United States Patent
Kamiyama et al.

(10) Patent No.: US 8,136,489 B2
(45) Date of Patent: Mar. 20, 2012

(54) VARIABLE COMPRESSION RATIO INTERNAL COMBUSTION ENGINE

(75) Inventors: Eiichi Kamiyama, Mishima (JP); Daisuke Akihisa, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 648 days.

(21) Appl. No.: 12/226,105

(22) PCT Filed: May 7, 2007

(86) PCT No.: PCT/IB2007/001299

§ 371 (c)(1), (2), (4) Date: Oct. 8, 2008

(87) PCT Pub. No.: WO2007/132346

PCT Pub. Date: Nov. 22, 2007

(65) Prior Publication Data

US 2009/0277422 A1 Nov. 12, 2009

(30) Foreign Application Priority Data

May 11, 2006 (JP) ..... 2006-132851

(51) Int. Cl.
*F02B 75/04* (2006.01)

(52) U.S. Cl. ..... 123/48 C; 123/78 C; 123/78 R; 123/327; 123/698; 123/699; 123/184.45; 123/184.52

(58) Field of Classification Search ..... 123/327, 123/433, 429, 698, 699, 184.45, 184.52, 123/78 R, 48 C See application file for complete search history.

(56) References Cited

U.S. PATENT DOCUMENTS

| | | | | |
|---|---|---|---|---|
| 4,519,346 | A * | 5/1985 | Nakanishi et al. | 123/188.14 |
| 5,711,269 | A * | 1/1998 | Oda et al. | 123/262 |
| 7,204,225 | B2 * | 4/2007 | Kubo et al. | 123/266 |
| 2007/0227503 | A1 * | 10/2007 | Hitomi et al. | 123/406.45 |

FOREIGN PATENT DOCUMENTS

| | | |
|---|---|---|
| DE | 10 2004 031 288 A1 | 1/2006 |
| DE | 10 2004 031 289 A1 | 1/2006 |
| GB | 2 367 859 A | 4/2002 |
| JP | A-59-126049 | 7/1984 |
| JP | A-3-64649 | 3/1991 |
| JP | B2-4-4458 | 1/1992 |
| JP | A-5-187239 | 7/1993 |
| JP | A-6-81656 | 3/1994 |
| JP | A-8-296463 | 11/1996 |
| JP | A-10-184370 | 7/1998 |
| JP | A-2001-317383 | 11/2001 |
| JP | A-2003-206771 | 7/2003 |
| JP | A-2003-293805 | 10/2003 |
| JP | A-2004-232580 | 8/2004 |

* cited by examiner

*Primary Examiner* — Noah Kamen
*Assistant Examiner* — Long T Tran
(74) *Attorney, Agent, or Firm* — Oliff & Berridge, PLC

(57) ABSTRACT

In a variable compression ratio internal combustion engine that controls the compression of an internal combustion engine by changing the volume of the combustion chamber of the internal combustion engine in an axial direction of the cylinder, when a target compression ratio (εt) based on an operating condition of the internal combustion engine is at a reference compression ratio (ε0) or greater (S102), the compression ratio is changed to the target compression ratio (S103). When the target compression ratio (εt) is lower than the reference compression ratio (ε0) (S102), a control is executed to change the compression ratio and also to strength the tumble flow in the combustion chamber (S104).

35 Claims, 13 Drawing Sheets a b,c
5,8
9
4
9b,9c
9a
2
3
a
b
c
5
8
9b
9c

VARIABLE COMPRESSION RATIO INTERNAL COMBUSTION ENGINE

BACKGROUND OF THE INVENTION

1. Field of the Invention

The present invention relates to a variable compression ratio internal combustion engine having a function that changes the compression ratio and a function that controls the strength of tumble flow in the combustion chamber of the internal combustion engine.

2. Description of the Related Art

In recent years, there has been proposed art capable of changing the compression ratio of an internal combustion engine for the purpose of improving fuel economy performance, output performance, and the like. Such art includes art in which a cylinder block and a crankcase are coupled with each other to enable relative movement therebetween, and camshafts are provided on the coupling portions thereof, the camshafts being rotated to cause relative movement between the cylinder block and the crankcase along the axial direction of the cylinder to change the volume of the combustion chamber and change the compression ratio of the internal combustion engine (for example, refer to the Japanese Patent Application Publication No. JP-A-2003-206771).

Another art has also been proposed in which a rocking member capable of rocking about a prescribed rocking center is linked to the part of a connecting rod that is divided into two that is linked to the crankshaft, the rocking center being moved by rotating the camshaft to change the volume of the combustion chamber and the stroke of the piston, thereby changing the compression ratio of the internal combustion engine (for example, refer to Japanese Patent Application Publication No. JP-A-2001-317383).

In the foregoing art, because the compression ratio is changed by changing the volume of the combustion chamber in the axial direction of the cylinder, if the compression ratio of the internal combustion engine is set low, the height of the combustion chamber is increased, and there are cases in which it is difficult to form a squish area within the internal combustion engine. When this occurs, it is not possible to sufficiently increase the speed of combustion in the internal combustion engine, and the thermal efficiency is decreased, leading to a tendency for knocking to occur.

With regard to this, yet another art has been proposed for causing a swirl controller to operate to increase the strength of swirl flow when the compression ratio is reduced (for example, refer to Japanese Examined Patent Application Publication No. JP-B-4-4458). However, in a variable compression ratio internal combustion engine in which the compression ratio is changed by changing the volume of the combustion chamber in the axial direction of the cylinder, because there is a change in the force in particular in the cylinder axial direction with respect to the intake flow, the influence of tumble flow, which is a vertical whirl, is greater than the influence of a swirl flow, which is a lateral whirl. Therefore, it could not be said that merely increasing the strength of the swirl flow enabled a sufficient improvement in the combustion condition under the condition of a low compression ratio. Further related arts have also been proposed in Japanese Patent Application Publications No. JP-A-2004-232580 and No. JP-A-2003-293805.

SUMMARY OF THE INVENTION

The present invention enables the maintenance of a proper combustion condition in a combustion chamber of an internal combustion engine, regardless of the compression ratio.

The most salient feature of a first aspect of the present invention is that a variable compression ratio internal combustion engine executes a control to change the strength of a tumble flow in the combustion chamber according to a compression ratio in the internal combustion engine.

More specifically, the variable compression ratio internal combustion engine has a variable compression ratio mechanism that changes the volume in a combustion chamber of the internal combustion engine in the axial direction of a cylinder to control the compression ratio of the internal combustion engine, and a tumble flow strength controller that executes a control to change the strength of the tumble flow in the combustion chamber, wherein the tumble flow strength controller executes the control to change the strength of the tumble flow in the combustion chamber according to the compression ratio controlled by the variable compression ratio mechanism.

By doing this, because the tumble flow strength controller executes the control to change the strength of the tumble flow generated in the combustion chamber according to the ease of generating a tumble flow, which depends on the volume and height of the combustion chamber, a sufficient tumble flow may be generated in the combustion chamber regardless a compression ratio. As a result, a proper combustion condition in the combustion chamber may be maintained regardless of the compression ratio In the above aspect, the tumble flow strength controller may make the tumble flow the stronger as the compression ratio decreases.

As the height of the combustion chamber increases, the compression ratio of the internal combustion engine decreases, it becomes more difficult to generate the tumble flow in a condition in which the compression ratio is low. In the aspect of the present invention, therefore, the tumble flow strength controller executes the control in which the strength of the tumble flow is made stronger the lower the compression ratio of the internal combustion engine. By doing this, even when the compression ratio is low and the height of the combustion chamber is increased, it is possible to generate tumble flow with a sufficient strength in the combustion chamber to improve the condition of combustion in the combustion chamber.

In the above aspect, the tumble flow strength controller may execute the control to strengthen the tumble flow if the compression ratio is below a first prescribed compression ratio.

In this case, a condition in which a compression ratio is a first prescribed compression ratio is taken as a threshold, and if the compression ratio is below the threshold, the tumble flow strength controller executes the control to strengthen the tumble flow. Specifically, the two-stage control according to the compression ratio with regard to the strength of the tumble flow is executed. This makes it possible to generate the sufficient strength in the combustion chamber using simple control regardless the compression ratio. The predetermined first compression ratio is the compression ratio below which the combustion speed in the combustion chamber becomes slow and it becomes difficult to maintain the proper combustion condition in the combustion chamber, unless the control that strengthens the strength of the tumble flow is executed. The first compression ratio, therefore, may be experimentally determined in advance.

In the above aspect, the tumble flow strength controller may execute the control to strengthen the tumble flow if the compression ratio is below a second prescribed compression ratio when the engine load of the internal combustion engine is below a first prescribed load.

In control of the compression ratio in the internal combustion engine, the cause of a reduced compression ratio is often a relative high-load operating condition. When the engine speed is high, however, the compression ratio sometimes is set to be low in a low-load operating condition. In contrast, when the tumble flow strength controller executes the control to strengthen the tumble flow, the intake flow itself is to be changed, as a result, there are many cases in which the in-flow of intake air is hindered. In an excessively high-load operating condition, therefore, it is undesirable to execute the control to strengthen the tumble flow. In this aspect of the present invention, therefore, when the compression ratio is below the second prescribed compression ratio and also the engine load of the internal combustion engine is below the first prescribed load, the control to strengthen the tumble flow is executed.

By doing this, when the generation of the tumble flow is difficult due to the increase in the height of the combustion chamber, and also even if control that strengthens the tumble flow is executed when the operating performance of the internal combustion engine is not affected, it is possible to perform control to strengthen the tumble flow. It is therefore possible to maintain suitable combustion condition of the internal combustion engine regardless the compression ratio without influencing the operating performance of the internal combustion engine. The second prescribed compression ratio refers to the compression ratio below which a combustion speed in the combustion chamber becomes slow and it is difficult to maintain appropriate combustion condition, unless control to strengthen the tumble flow is executed, and the compression ratio may also be the same compression ratio as the first prescribed compression ratio. The first prescribed load is a threshold engine load, and if the engine load of the internal combustion engine is below the first prescribed load, even if control to strengthen the tumble flow is executed, operating performance of the engine is not greatly influenced, and this threshold may be experimentally determined in advance.

In the above aspect, the tumble flow strength controller may execute the control to strengthen the tumble flow if the compression ratio is below a third prescribed compression ratio and if the compression rate is above a fourth prescribed compression ratio.

In this case, if the compression ratio is low, it may be difficult to generate a tumble flow in the combustion chamber for the reasons described above. In contrast, if the compression ratio is high, because the combustion chamber becomes flattened in shape, the value obtained by dividing the surface area of the combustion chamber by the volume thereof (hereinafter, S/V ratio) increases and, as a result, there is tendency for thermal efficiency in the combustion chamber to be reduced. This may cause the combustion stability in the combustion chamber to deteriorate.

In the above aspect, the tumble flow strength controller executes controls to strengthen the tumble flow when the compression ratio is below the third prescribed compression ratio, and also when the compression ratio is above the fourth prescribed compression ratio. By doing this, in a case in which it is difficult to generate the tumble flow because of low compression ratio and also even when thermal efficiency in the combustion chamber is decreased because of high compression ratio, and the combustion efficiency in the combustion chamber is reduced, the tumble flow in the combustion chamber is strengthened to stabilize combustion.

The third prescribed compression ratio is a compression ratio below which combustion speed in the combustion chamber becomes slow unless the control to strengthen the tumble flow is executed, and it is difficult to maintain a proper combustion condition. The third prescribed compression ratio may be set equal to the first prescribed compression ratio. The fourth prescribed compression ratio is a compression ratio above which combustion becomes unstable, unless the control to strengthen the tumble flow is executed because of the decreasing thermal efficiency in the combustion chamber. The fourth prescribed compression ratio may be experimentally determined in advance.

In the above aspect, if the compression ratio is below a fifth prescribed compression ratio, the tumble flow strength controller may make the tumble flow stronger with increasing the compression ratio. If the compression ratio is higher than a sixth prescribed compression ratio, the tumble flow strength control may make the tumble flow stronger with increasing compression ratio.

Specifically, it is not that when the compression ratio is merely below a prescribed value and higher than a prescribed value, the control to strengthen the tumble flow is executed. In an aspect of this invention when the compression ratio is below the fifth prescribed compression ratio, the strength of the tumble flow may be increased as the compression ratio decreases. On the other hand, when the compression ratio is the above the sixth prescribed compression ratio or higher, the strength of the tumble flow may be increased as the compression ratio increases. By doing this, it is possible to more accurately control the strength of tumble flow according to the compression ratio, enabling more reliable maintenance of an optimum combustion condition in the internal combustion engine regardless of the compression ratio. Furthermore, the fifth prescribed compression ratio may be set equal to the third prescribed compression ratio, and the sixth prescribed compression ratio may be set equal to the fourth prescribed combustion ratio.

In the above aspect, the tumble flow strength controller may execute the control to change the strength of the tumble flow by switching an opening and closing of a tumble control valve disposed within the intake port of the internal combustion engine. The tumble flow strength controller may also execute control to change the strength of the tumble flow by changing the timing of the opening of an intake valve during an intake stroke of the internal combustion engine. The axial cross-sectional shape of an intake port of a cylinder in the internal combustion engine may be established so that the width of the cross-section of the intake port is larger toward the center of the combustion chamber than toward the periphery of the combustion chamber. Concave and convex portions may be formed in the uppermost surface of the piston of the internal combustion engine to promote generation of the tumble flow.

The above-described aspect of the present invention may be used by a variable combination as long as it is possible.

According to an aspect of the present invention, the variable compression ratio internal combustion engine can maintain a proper combustion condition in the combustion chamber regardless of the compression ratio.

BRIEF DESCRIPTION OF THE DRAWINGS

The foregoing and further objects, features, and advantages of the invention will become apparent from the following description of example embodiments with reference to the accompanying drawings, wherein like numerals are used to represent like elements, and wherein.

DETAILED DESCRIPTION OF THE INVENTION

Example embodiments of the present invention are described in detail below, with references made to the accompanying drawings.

The first embodiment of the present invention will now be described. The internal combustion engine 1 described below is a variable compression ratio internal combustion engine that changes the compression ratio by causing movement of a cylinder block 3 having cylinders 2 with respect to the crankcase 4 to which the pistons are linked, in the center axial direction of the cylinders 2.

Figure 1:
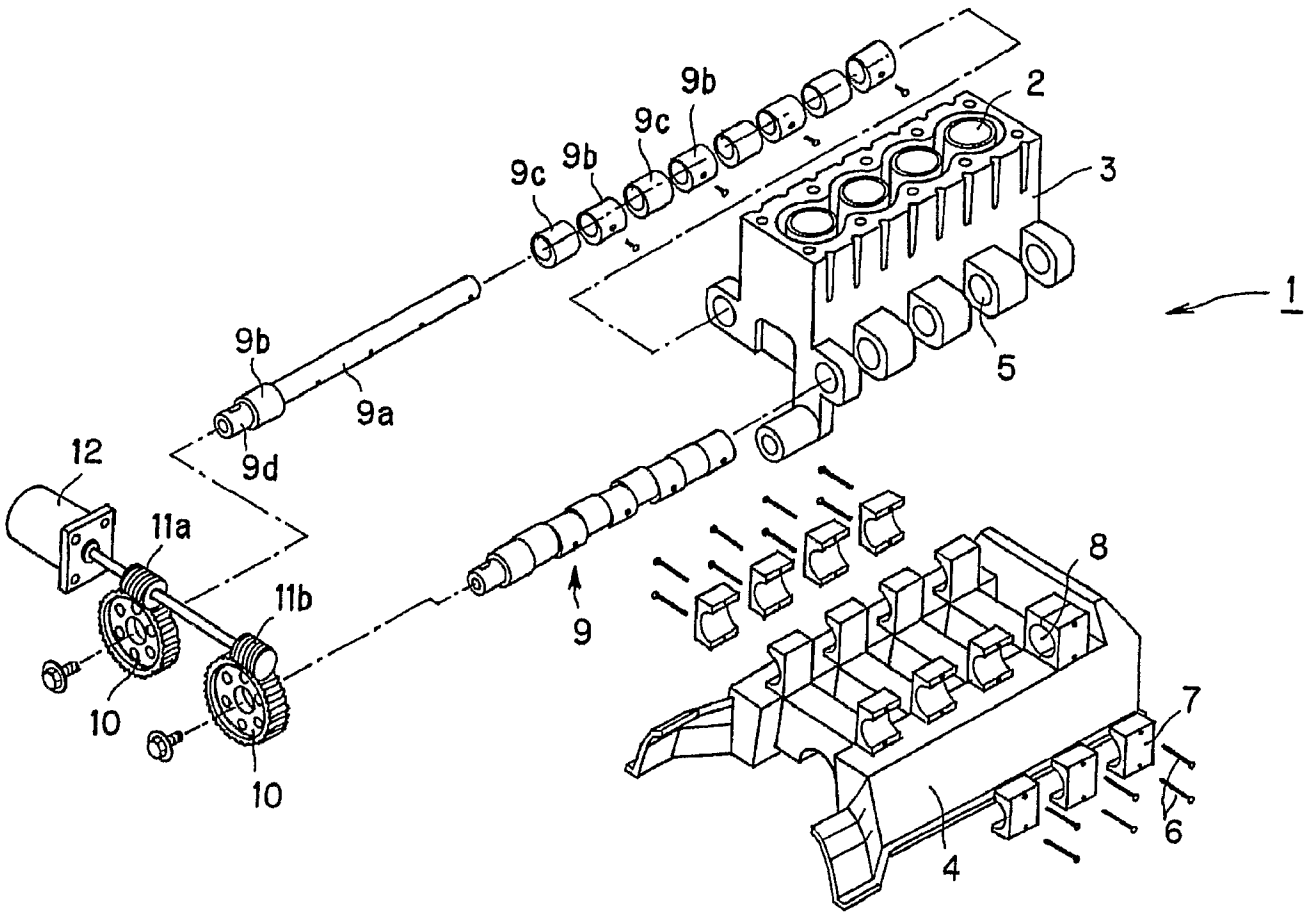
FIG. 1 is an exploded perspective view showing the general configuration of a variable compression ratio internal combustion engine according to an embodiment of the present invention.

First, referring to FIG. 1, the constitution of this embodiment for changing the compression ratio will be described. As shown in FIG. 1, a plurality of protruding parts are formed on both sides of the lower part of the cylinder block 3, and cam housing hole 5 are formed in each of these protruding parts. The cam housing holes 5, each having a circular shape, extend perpendicularly to the axial direction of the cylinders 2, and are also formed in a direction parallel to the arrangement of the plurality of cylinders 2. The cam housing holes 5 on one side of the cylinder block 3 are all disposed along one and the same axis line, and the axis lines of the cam housing holes 5 on two sides of the cylinder block 3 form a pair of parallel axis lines.

The crankcase 4 has vertical wall parts formed between the plurality of protruding parts in which the above-described cam housing holes 5 are formed. A semicircular depression is formed in the surface of each vertical wall part on the outside of the crankcase 4. Each vertical wall part also has a cap 7 mounted by a bolt 6, and the caps 7 also have semicircular depressions. When the caps 7 are mounted to respective vertical wall parts, circular bearing housing holes 8 are formed. The shape of the bearing housing holes 8 is the same as that of the cam housing holes 5.

The plurality of bearing housing holes 8, in the same manner as the cam housing holes 5, extend perpendicularly to the axial direction of the cylinders 2 when the cylinder block 3 is mounted to the crankcase 4, and also are each formed to be parallel to the direction of arrangement of the plurality of cylinders 2. These bearing housing holes 8 are also formed on two sides of the cylinder block 3, and all of the bearing housing holes 8 formed on one side of the cylinder block 3 are all disposed along one and the same axis line. The pair of axis lines of bearing housing holes 8 on two sides of the cylinder block 3 are parallel to one another. The distance between centers of the cam housing holes 5 on two sides and the distance between centers of the bearing housing holes 8 on two sides are the same.

A camshaft 9 is passed through each of the opposing two rows of cam housing holes 5 and bearing housing holes 8. As shown in FIG. 1, each of the camshafts 9 has a shaft member 9*a*, cam members 9*b* having circular cam profiles and fixed to the shaft member 9*a* eccentrically with respect to the center of the shaft member 9*a*, and movable bearing members 9*c* rotatably fixed to the shaft member 9*a* and also having a circular outer shape. The cam members 9*b* and the movable bearing members 9*c* are alternately disposed. The pair of camshafts 9 are in a mirror-image relationship. A mounting part 9*d* for mounting a gear 10, described below, is formed on the end parts of the camshafts 9. The center axis of the camshaft 9*a* and the center axis of the mounting part 9*d* are mutually eccentric, the center of the cam member 9*b* and the center of the mounting part 9*d* are coaxial.

The moving bearing member 9*c* is also eccentric with respect to the bearing member 9*a*. In each of the camshafts 9, the direction of eccentricity of the plurality of the cam members 9*b* is the same. Because the outer shape of the movable bearing member 9*c* is a true circle having the same diameter as the cam member 9*b*, by rotating the movable bearing member 9*c*, it is possible to cause the outer surface of the plurality of cam members 9*b* to coincide with the outer surface of the plurality of movable bearing members 9*c*.

A gear 10 is mounted on one end of each of the camshafts 9. Each of the gears 10 fixed to the end parts of the pair of camshafts 9 engages with worm gears 11*a*, 11*b*. The worm gears 11*a*, 11*b* are fixed to one output shaft of a single motor 12. The worm gears 11*a*, 11*b* have helical grooves that rotate in mutually opposite directions. For this reason, when the motor 12 rotates, the pair of camshafts 9 rotate, via the gears 10, in mutually opposite directions. The motor 12 is fixed to the cylinder block 3 and moves in concert with the cylinder block 3.

Figures 2A, 2B, 2C:
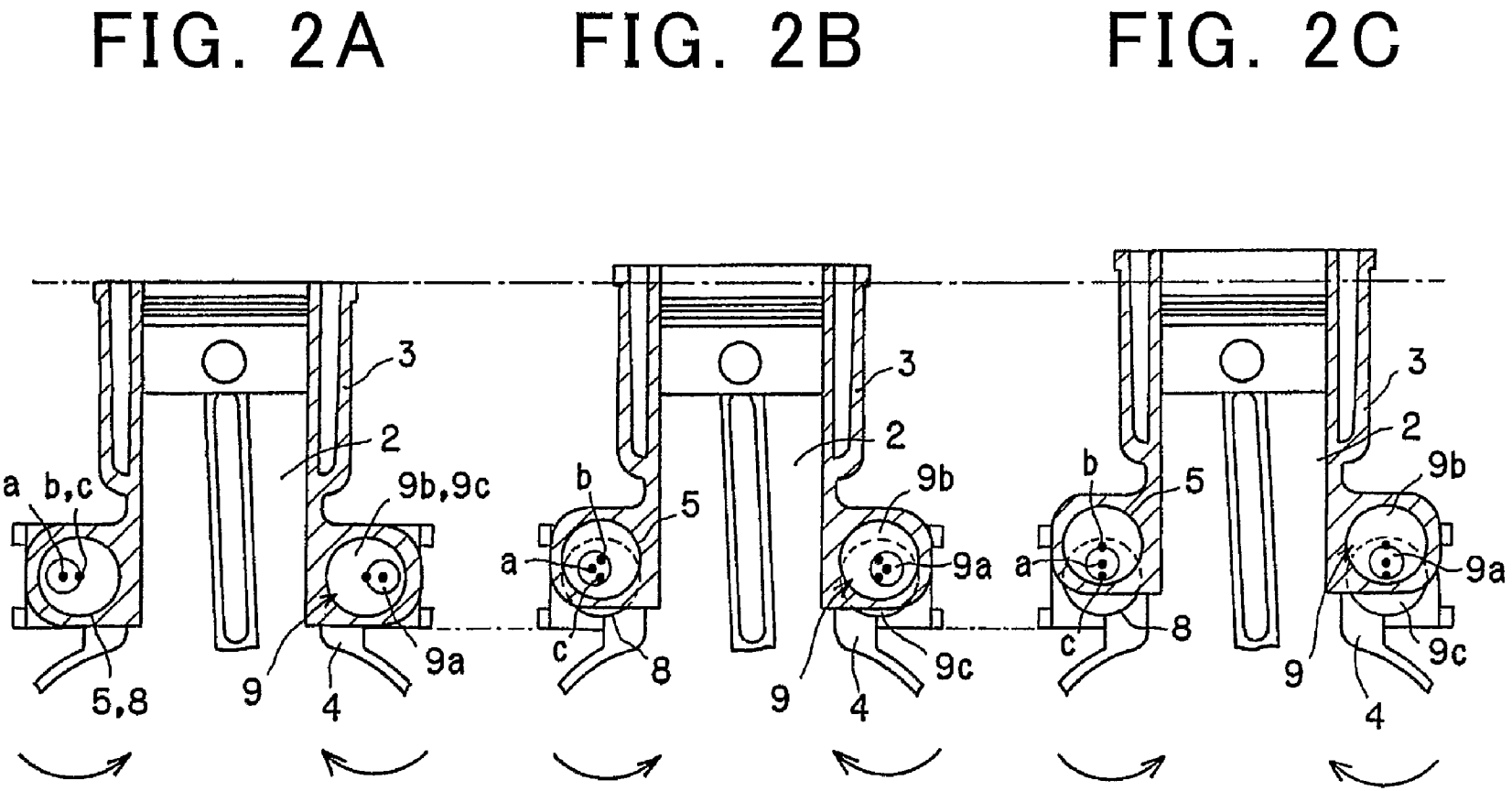
FIG. 2A through FIG. 2C are cross-sectional views showing the progress of relative movement of the cylinder block with respect to the crankcase in a variable compression ratio internal combustion engine according to the embodiment of the present invention.

In an internal combustion engine 1 configured as described above, the method in which the compression ratio is controlled as follows. FIG. 2A through FIG 2C are cross-sectional views showing the operational relationship between the cylinder block 3, the crankcase 4, and the camshafts 9 assembled therebetween. In FIG. 2A through FIG. 2C, a denotes the center of the shaft member 9*a*, b denotes the center of the cam member 9*b*, and c denotes the center of the movable bearing member 9*c*. FIG. 2A shows the condition in which, as viewed from a line extending along the shaft member 9*a*, the outer peripheries of all the cam members 9*b* and the movable bearing members 9*c* coincide. In this condition, the pair of shaft members 9*a* are positioned at the outside within the cam housing holes 5 and the bearing housing holes 8.

From the condition shown in FIG. 2A, if the motor 12 is driven to rotate the shaft member 9*a* in the direction of the arrow, the condition shown in FIG. 2B occurs. When this occurs, because an offset occurs in the cam member 9*b* and the movable bearing member 9*c* with respect to the shaft member 9*a*, the cylinder block 3 can slide toward the top dead center with respect to the crankcase 4. The amount of slide is maximum when the camshaft 9 is rotated up to the condition shown in FIG. 2C, the amount of eccentricity of the cam member 9*b* and the movable bearing member 9*c* being doubled. The cam members 9*b* and the movable bearing members 9*c* rotate within the cam housing holes 5 and the bearing housing holes 8, respectively, and the positions of the shaft members 9*a* are allowed to move within the bearing housing holes 8 and the cam housing holes 5.

By using a mechanism as described above, it is possible to move the cylinder block 3 in the axial direction of the cylinder 12 relatively with respect to the crankcase 4, thereby enabling a control of the change in the compression ratio. The above-described constitution corresponds to the variable compression ratio internal combustion engine of this embodiment.

Consider the condition in which the compression ratio in the internal combustion engine 1 is made low. In this condition, because the cylinder block 3 is distanced from the crankcase 4, the height of the combustion chamber is relatively high. When this occurs, it might be difficult to form a squish area in the combustion chamber. As a result, the speed of combustion in the combustion chamber decreases, and there are cases in which it is difficult to maintain a proper combustion condition.

Given the above, in the case in which the compression ratio in the internal combustion engine 1 is made lower than a prescribed value, this embodiment performs concurrent control to strengthen the tumble flow in the combustion chamber.

Figure 3:
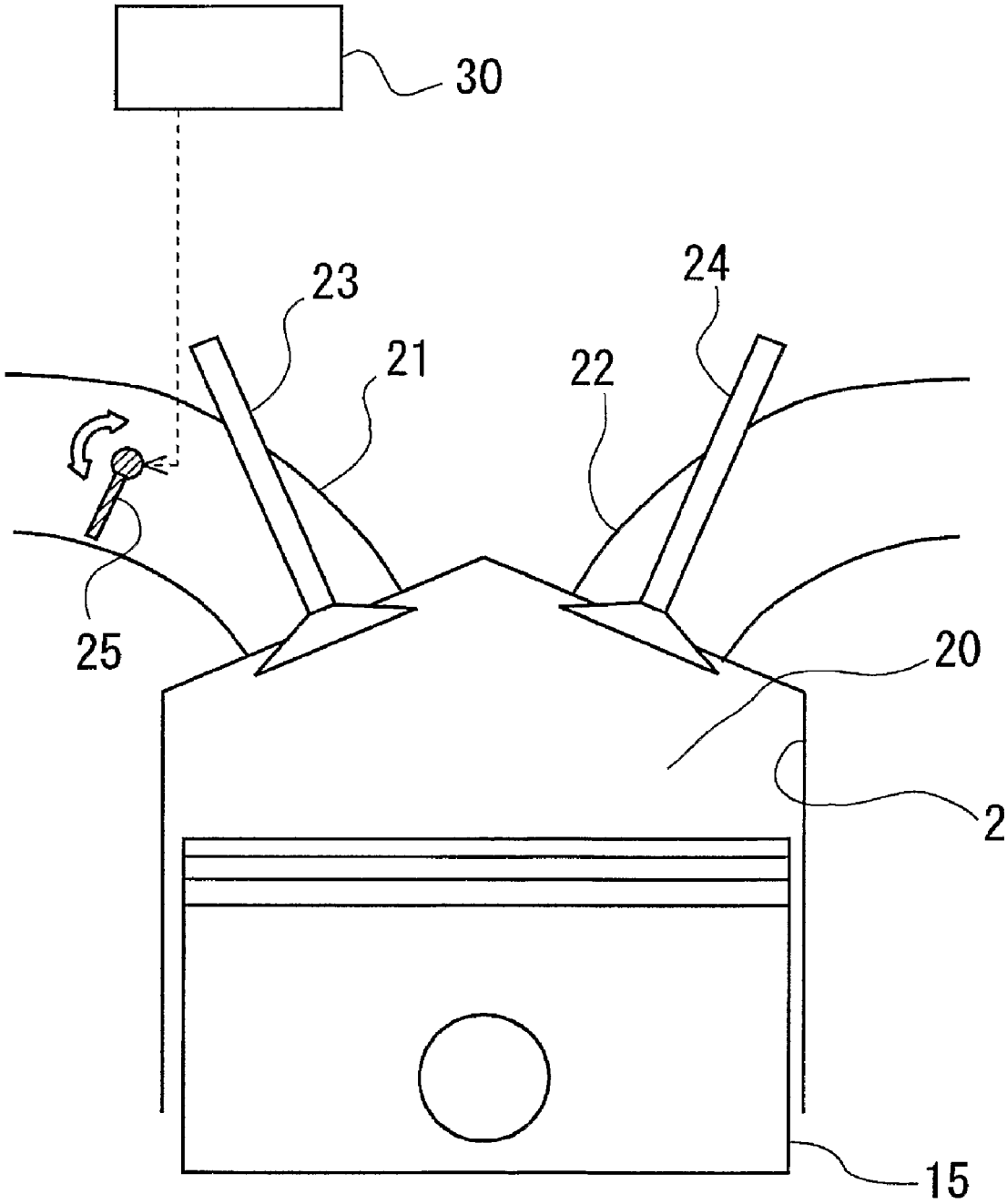
FIG. 3 is a drawing showing details of the vicinity of the combustion chamber of an internal combustion engine according to a first embodiment of the present invention.

FIG. 3 shows details of the vicinity of the combustion chamber of the internal combustion engine 1. In this embodiment, an intake port 21 and an exhaust port 22 are connected to the cylinder 2, the ports are provided with an intake valve 23 and an exhaust valve 24, respectively, which can move reciprocally. A tumble control valve (hereinafter, TCV) 25 that adjusts the strength of tumble flow in the combustion chamber 20 is provided in the intake port 21. By closing the TCV 25, it is possible to divert the intake air flowing through the intake port 21 to strengthen the tumble flow generated within the combustion chamber 20. An electronic control unit (hereinafter, ECU) 30 is also provided within the internal combustion engine 1. The ECU 30, in addition to executing controls related to the operation of the internal combustion engine 1, executes the control to change the compression ratio as noted above, and control to change the strength of the tumble flow within the combustion chamber 20.

Figure 4:
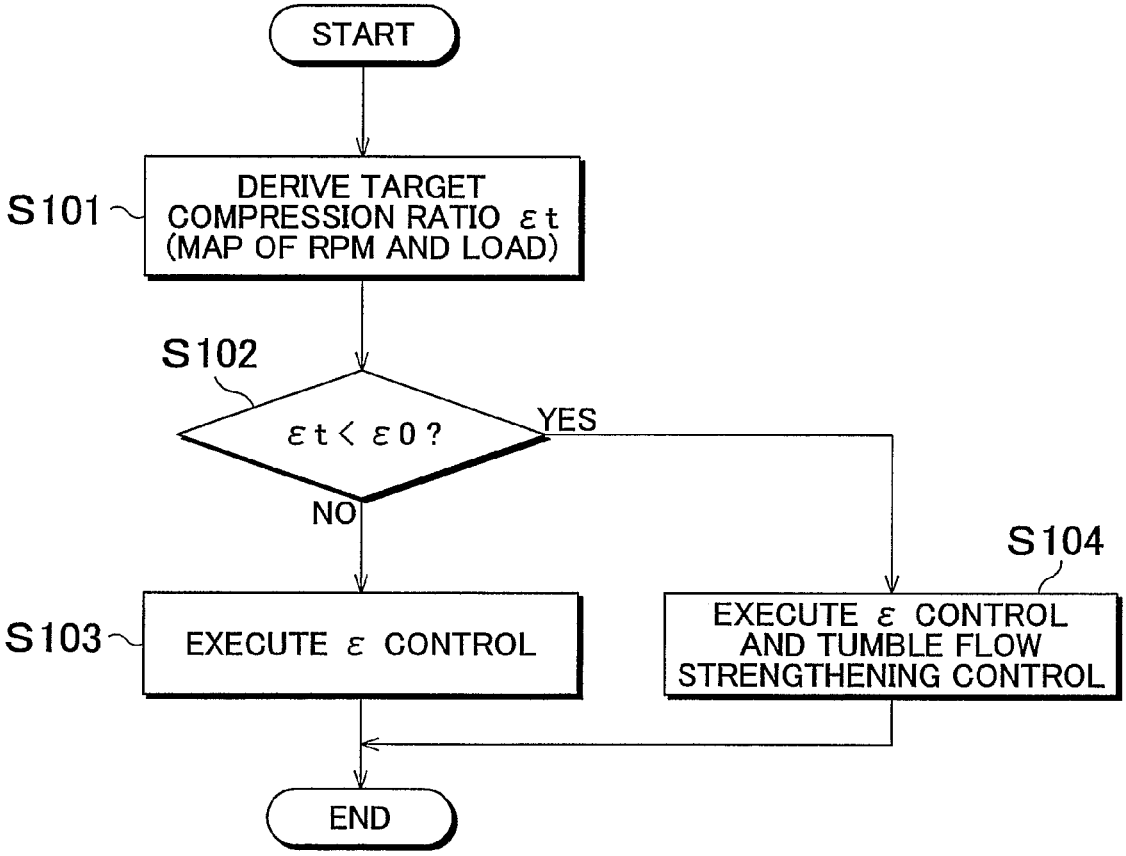
FIG. 4 is a flowchart showing a compression ratio changing routine according to the first embodiment of the present invention.

FIG. 4 shows the compression ratio changing routine in this embodiment. This routine is a program stored in a ROM within the ECU 30, and is executed each prescribed intervals by the ECU 30 during operation of the internal combustion engine 1.

First, when this routine is executed, at step S101 the compression ratio $\epsilon t$ to be set as the target at that point in time is determined in response to the operating condition of the internal combustion engine 1 obtained from a crank position sensor and accelerator position sensor (not shown). Specifically, from a stored map of the relationship between the speed and the load of the internal combustion engine 1 and the target compression ratio $\epsilon t$, a target compression ratio $\epsilon t$ corresponding to the operating condition of the internal combustion engine 1 at that point in time is read out. When S101 is completed, process proceeds to step S102.

At step S102, it is determined whether the target compression ratio $\epsilon t$ is below a reference compression ratio $\epsilon 0$. The reference compression ratio $\epsilon 0$ is the threshold value of compression ratio, below which it is determined that the height of the combustion chamber 20 increases, making it difficult to form a squish area in the combustion chamber 20, and resulting in unstable combustion. If the target compression ratio $\epsilon t$ is determined at step S102 to be equal to or above the reference compression ratio $\epsilon 0$, the process proceeds to step S103. However, if it is determined that the target compression ratio $\epsilon t$ is below the reference compression ratio $\epsilon 0$, the process proceeds to step S104.

At step S103, a compression ratio control is executed. Specifically, the motor 12 is electrically driven to rotate the camshaft 9 so that the compression ratio of the internal combustion engine 1 becomes the target compression ratio $\epsilon t$. When step S103 is completed, the routine is provisionally ended.

At step S104, in addition to executing the compression ratio control in the same manner as in step S103, a control is executed to strengthen the tumble flow. Specifically, the motor 12 is electrically driven to rotate the camshaft 9 so that the compression ratio of the internal combustion engine 1 becomes the target compression ratio $\epsilon t$, and the TCV 25 is closed to divert the intake air passes through the intake port 21 to strengthen the tumble flow generated in the combustion chamber 20. When step S104 is completed, the routine is provisionally ended.

As described above, if the target compression ratio $\epsilon t$ in the internal combustion engine 1 is below the reference compression ratio $\epsilon 0$, this embodiment performs compression ratio control and also executes a control to strengthen the tumble flow generated in the combustion chamber 20. By doing this, it is possible to suppress weakening of the tumble. flow in the combustion chamber 20 due to the reduced compression ratio resulting from an increase in the height of the combustion chamber 20. By doing this, it is possible to maintain a proper combustion condition in the combustion chamber 20 regardless of the compression ratio. The ECU 30, which executes the control to strengthen the tumble flow at step S103 noted above is the tumble flow strengthening control apparatus according to this embodiment. The reference compression ratio $\epsilon 0$ corresponds to the first compression ratio in this embodiment.

Figure 5:
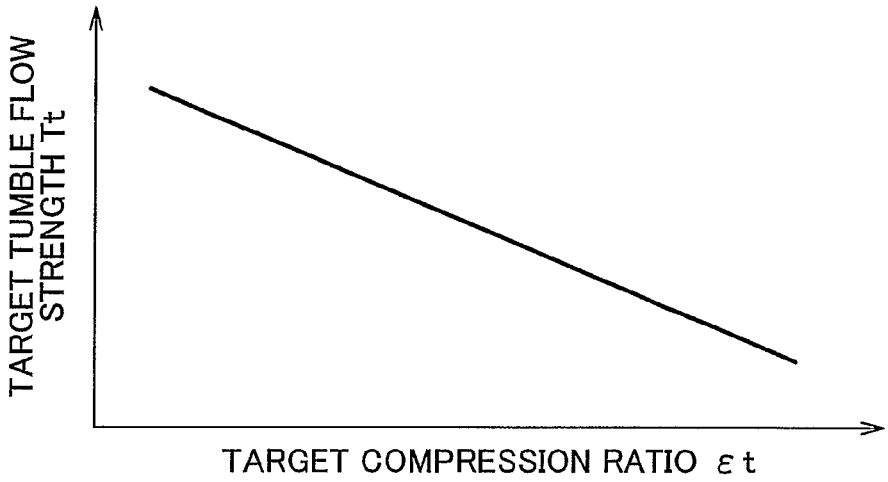
FIG. 5 is a graph showing the relationship between the compression ratio and the target tumble flow strength in the first embodiment of the present invention.

In the foregoing embodiment, two-stage control is performed, in which a determination of whether to execute the control to strengthen the tumble flow is made based on whether the target compression ratio $\epsilon t$ is below the reference compression ratio $\epsilon 0$. In contrast, a map of the relationship between the target compression ratio $\epsilon t$ and the corresponding target tumble flow strength for control of the optimum tumble flow strength may be experimentally pre-determined, and the control may be executed by reading from the map the target tumble flow strength Tt corresponding to the target compression ratio ϵt. FIG. 5 shows an example of the relationship between the target compression ratio ϵt and the target tumble flow strength Tt in the map. As shown in FIG. 5, the lower the target compression ratio ϵt, the higher the target tumble flow strength Tt can be made.

Doing this makes it possible to achieve a more accurate value of tumble flow strength in the combustion chamber 20, enabling more reliable maintenance of a proper combustion condition in the combustion chamber 20.

Figure 6:
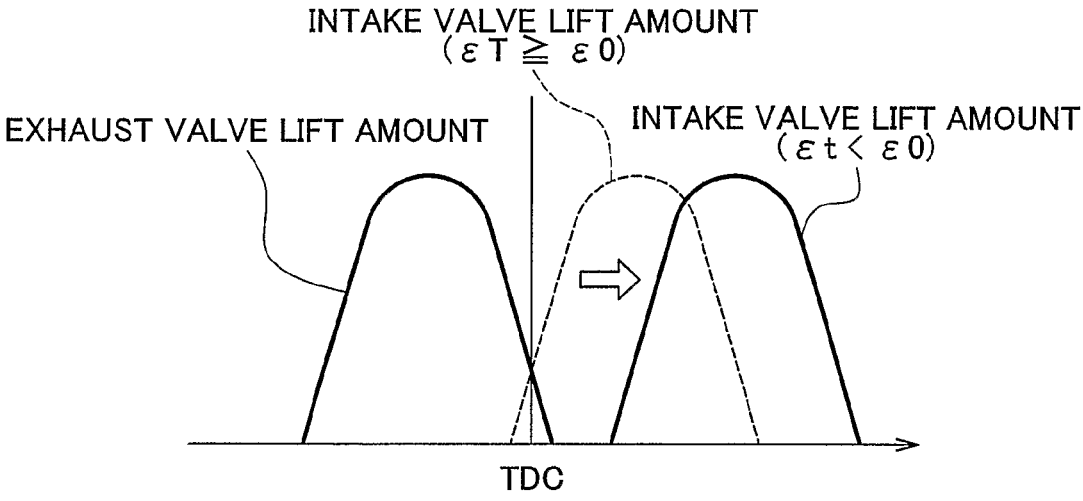
FIG. 6 is a graph showing the timing of the opening and closing of the intake valve and the exhaust valve according to the first embodiment of the present invention.

In the above-described embodiment, the method used to change the strength of the tumble flow is that of controlling the opening of the TCV 25. The method of changing the tumble flow strength in the combustion chamber 20 is not restricted to this method. For example, in place of the TCV 25, a variable valve timing mechanism (hereinafter, VVT mechanism, not shown) may be provided and, if the target compression ratio ϵt is below the reference compression ratio ϵ0, the VVT mechanism may delay the timing of the opening of the intake valve 23. Because the intake valve 23 opens after the piston 15 is lowered to some extent, it is possible to open the intake valve 23 in a condition in which the pressure difference between the intake port 21 and the combustion chamber 20 is large. Additionally, doing this makes it possible to strengthen the force of the intake air flowing in from the intake port 21, thereby strengthening the tumble flow in the combustion chamber 20. FIG. 6 shows an example of the timing of the opening and closing of the intake valve 23 and the exhaust valve 24 when this occurs.

The intake port 21 in the above-described embodiment may have a thickened part at the far upper end of the wall surface, so that the intake port itself is capable of strengthening the tumble flow by, for example, increasing the speed of flow of the intake air passing through the gap between the thickened part and the intake valve 23.

Figure 7:
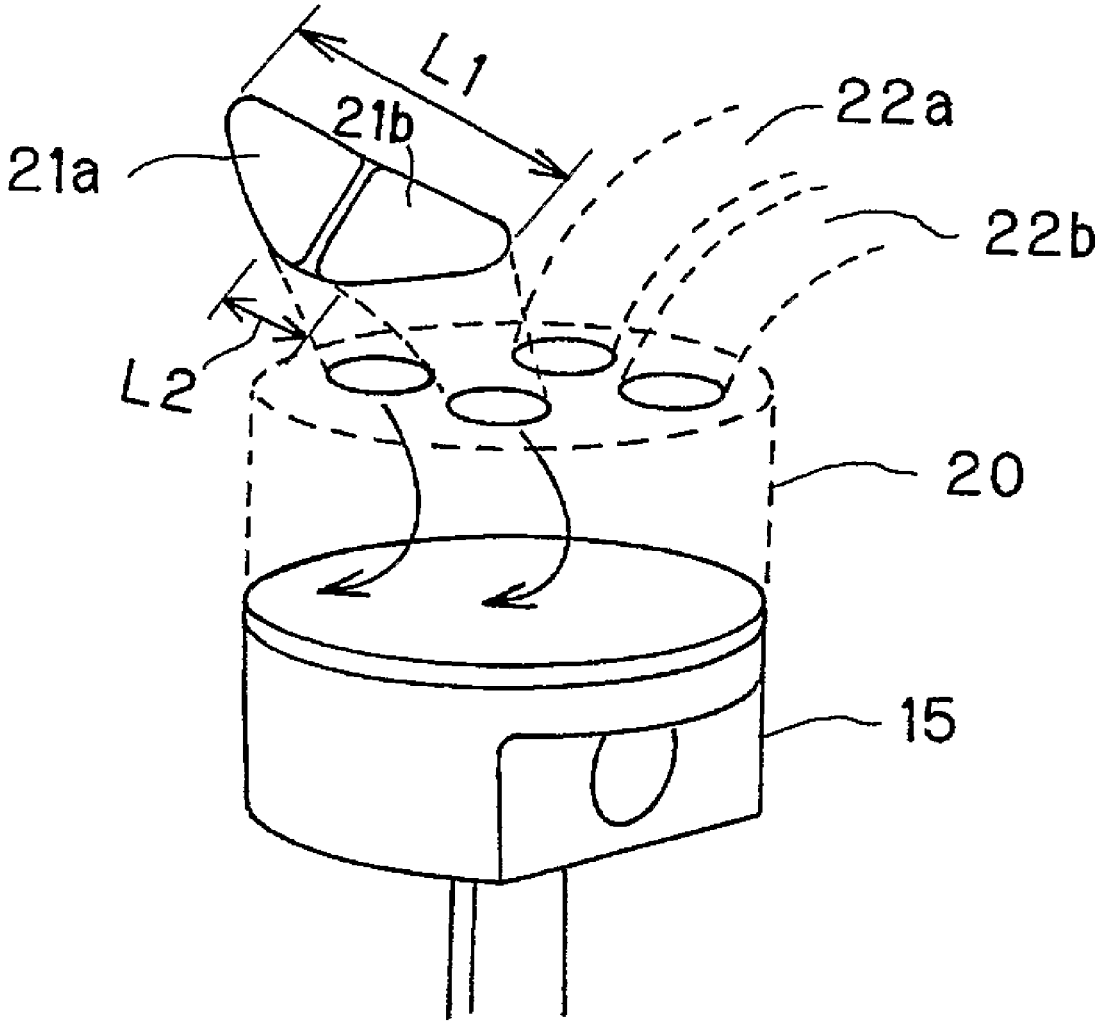
FIG. 7 is a drawing showing the cross-sectional shape of the intake port according to a second embodiment of the present invention.

The second embodiment of the present invention will now be described, using the example of a configuration capable of automatically controlling the strength of tumble flow in the combustion chamber in response to a change in the compression ratio. FIG. 7 shows details of the vicinity of the combustion chamber 20 in this embodiment. As shown in FIG. 7, in this embodiment the cross-section of the two intake ports 21*a* and 21*b* is a trapezoidal shape satisfying the condition L1>L2. That is, the width of the cross-sectional shape of the intake ports 21*a*, 21*b* is larger toward the center of the combustion chamber than it is toward the periphery of the combustion chamber.

In a constitution such as noted above, when operating under high-load conditions, and in a condition in which the filling rate of intake air into the combustion chamber 20 is high, it is known that the amount of intake air passing the center-side vicinity of the combustion chamber in the trapezoidally shaped intake ports 21*a*, 21*b* is relatively increased, and the strength of the tumble flow in the combustion chamber 20 increases. However, when operating under a high-load, in the condition in which the filling rate of intake air into the combustion chamber 20 is high, a control is usually executed to decrease the compression ratio. As a result, with this configuration, when the compression ratio is low, it is possible to execute an automatic control to strengthen the tumble flow in the combustion chamber 20.

Figure 8:
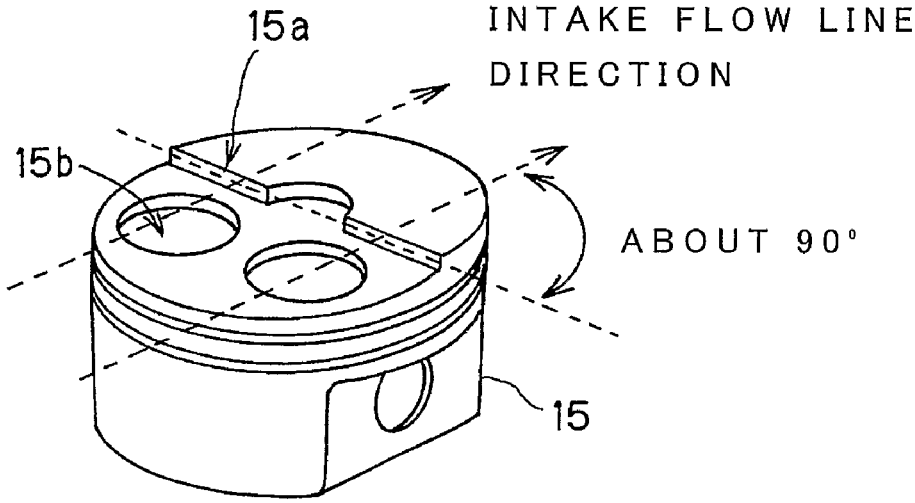
FIG. 8 is a drawing showing the shape of the uppermost surface of a piston according to the second embodiment of the present invention.
Figure 9:
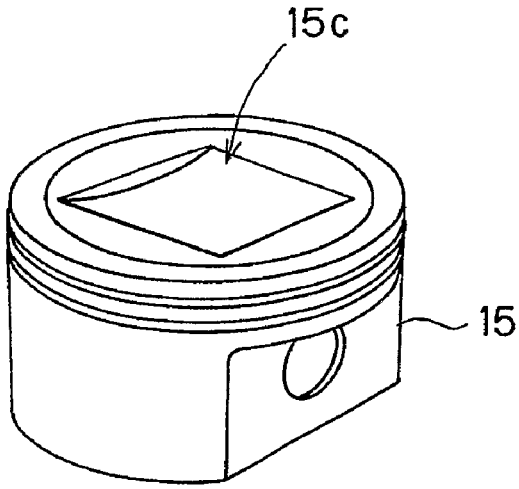
FIG. 9 is a drawing showing another example of the shape of the uppermost surface of a piston according to the second embodiment of the present invention.

In addition to the foregoing, prescribed concavities and convexities may be provided in the uppermost surface of the piston 15 to strengthen the tumble flow in the combustion chamber 20. Examples are shown in FIG. 8 and FIG. 9. FIG. 8 shows an example in which a step or slope 15*a* is provided in a direction substantially perpendicular to the flow of intake air in the uppermost surface of the piston 15. In this case, 15*b* is a recess for the intake valve. FIG. 9 shows an example in which a concave part 15*c* formed by a curved surface along the tumble flow that should be generated is formed in the uppermost surface of the piston 15. Providing these concave and convex parts in the uppermost surface of the piston 15 enables strengthening of the tumble flow in the combustion chamber 20.

Figure 10:
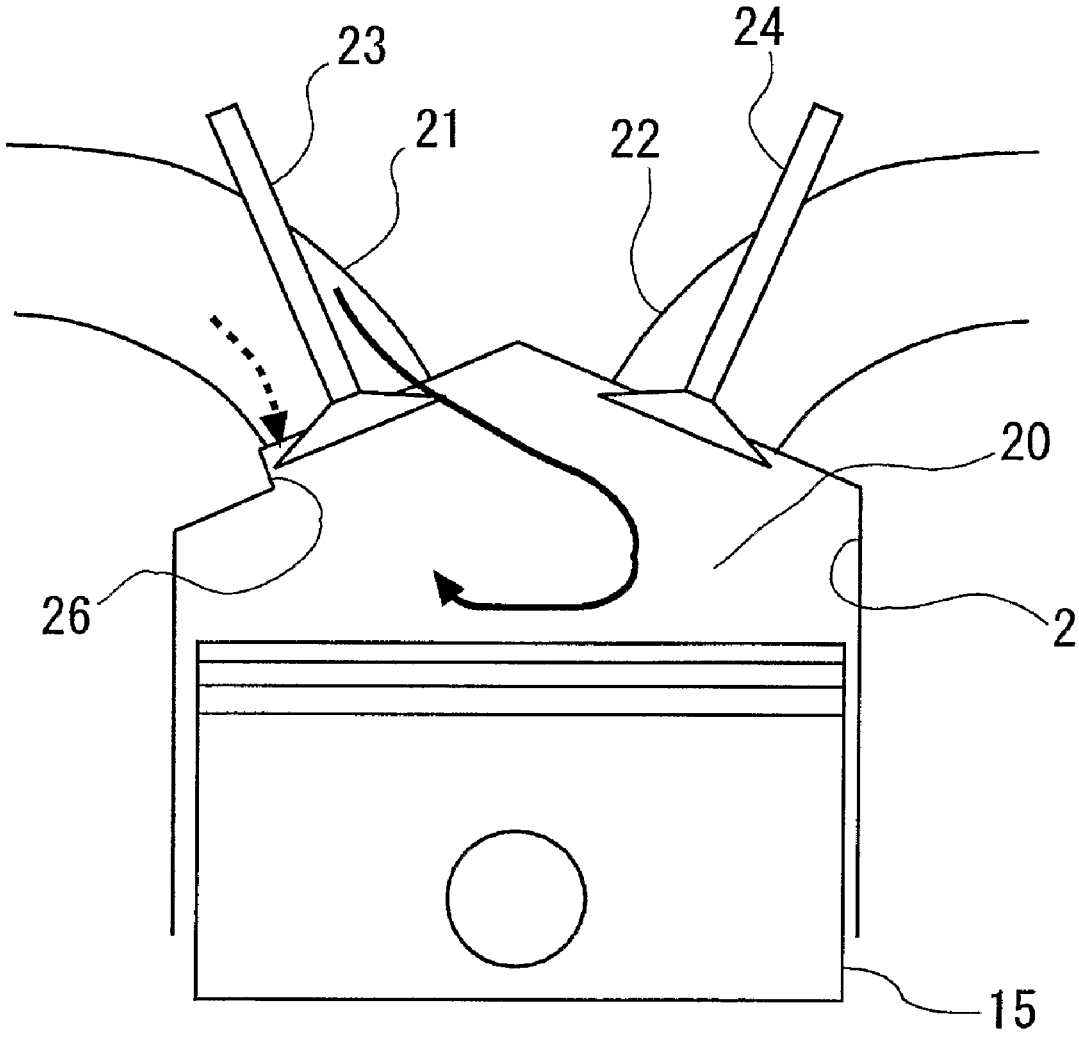
FIG. 10 is a drawing showing the shape of the ceiling surface of a combustion chamber according to the second embodiment of the present invention.

In this embodiment, a prescribed shape may be provided on the surface of the ceiling of the combustion chamber 20 to strengthen the tumble flow. For example, as shown in FIG. 10, a mask 26 is provided in part of the seat region of the intake valve 23, to impede the flow of intake air into the combustion chamber 20 from the region of the mask 26. By doing this, a large part of the intake air flows into the combustion chamber 20 from the side of the intake port 21 opposite from the mask 26, thereby strengthening the tumble flow.

In the foregoing embodiment, the tumble flow is strengthened when the compression ratio is low. The compression ratio is usually set to be low when the internal combustion engine 1 is operating under high-load. In a low compression ratio and high-load condition, therefore, the control is often executed to strengthen the tumble flow. In contrast, in the high-speed and low-load operating condition, there are cases in which the compression ratio is set to be low. In this embodiment, in such a low compression ratio and low-load condition (specifically, when, for example, the compression ratio is lower than the second reference compression ratio ϵ1 and the engine load is lower than the reference load), the control may be executed to strengthen the tumble flow.

In the control to strengthen the tumble flow, such a control is likely to be often performed to, for example, divert the intake air passing through the intake port 21, which hinders the flow of intake air into the combustion chamber 20. If the control to strengthen the tumble flow is executed when the compression ratio is low and the engine operates under a low load, however, even if the in-flow of intake air is hindered, the possibility that this will influence the operating performance of the internal combustion engine 1 is small. It is therefore possible to perform more suitable control to strengthen the tumble flow. In this case, the second reference compression ratio ϵ1 corresponds to the second compression ratio in this embodiment, and the reference load corresponds to the first load.

The third embodiment of the present invention will now be described, using the example in which the control is executed to strengthen the tumble flow when the compression ratio is low, and also the control is executed to strengthen the tumble flow when the compression ratio is high.

When the compression ratio is low under the conditions described above, it is difficult to generate a tumble flow and the combustion speed in the combustion chamber tends to be slow. In contrast, when the compression ratio is high, because the height of the combustion chamber is reduced, the combustion chamber is flattened and the ratio of surface area of the combustion chamber to the volume thereof (hereinafter, S/V ratio) is increased. As a result thermal efficiency may be reduced which leads to unstable combustion. Also, when the compression ratio is high and the engine operates under a low-load, there are cases in which, because of the reduced intake air amount, it is difficult to generate tumble flow.

In contrast to the above, this embodiment divides the region of compression ratio variation into three regions and executes control to strengthen the tumble flow in regions having both low and high compression ratio.

Figure 11:
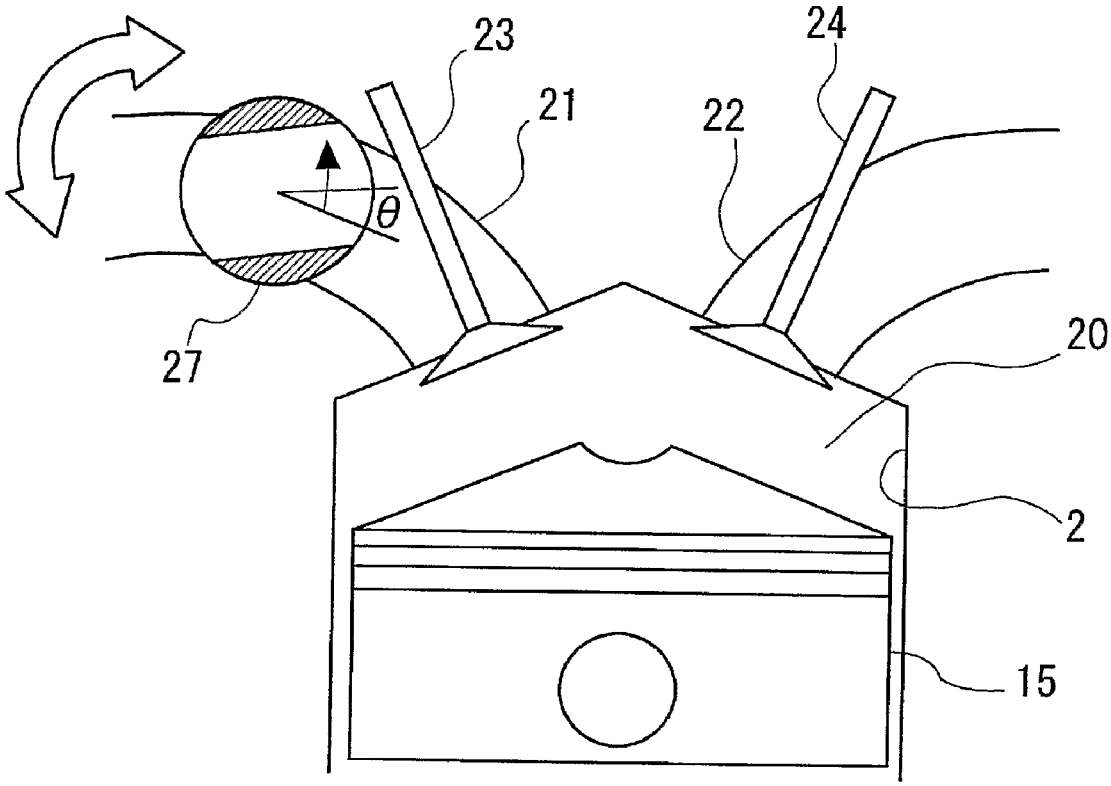
FIG. 11 is a drawing showing details of the vicinity of the combustion chamber of an internal combustion engine according to a third embodiment of the present invention.

FIG. 11 shows details in the vicinity of the combustion chamber 20 in this embodiment. A rotary valve 27 is used as a TCV in the embodiment. Because the embodiment uses a rotary valve 27, the air intake flow may be controlled without increasing the air intake resistance. In this case, the value of θ is 0° when the direction of the rotary valve 27 coincides with the direction of the intake port 21, in which condition diversion of the intake does not occur.

Figure 12A:
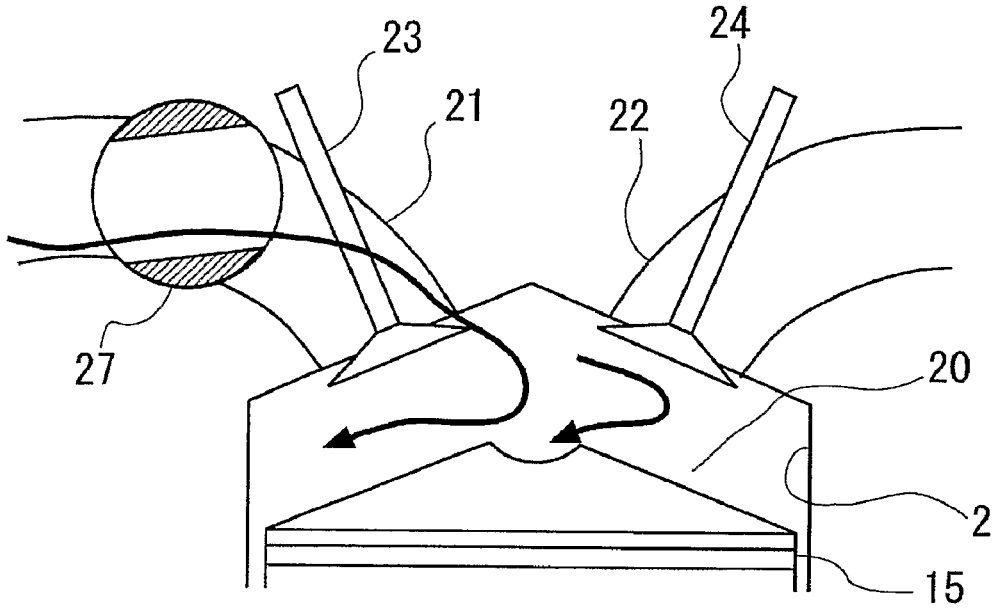
FIG. 12A and FIG. 12B are drawings illustrating the relationship between the attitude of the rotary valve and the intake flow according to the third embodiment of the present invention.
Figure 12B:
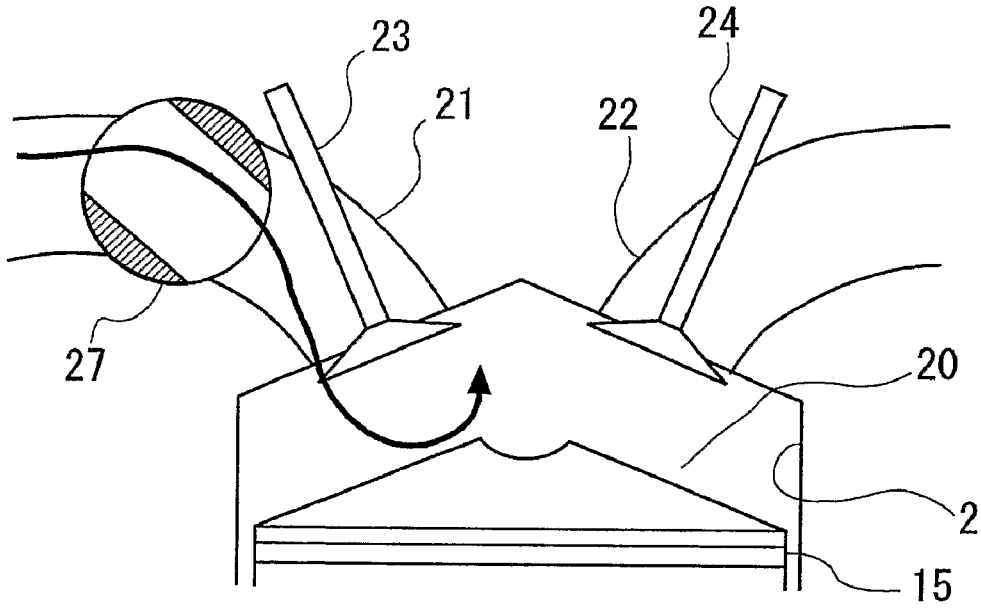

FIG. 12A shows the flow of intake air when the rotary valve 27 is rotated to the plus side, and FIG. 12B shows the flow of intake air when the rotary valve 27 is rotated to the minus side. As shown in FIG. 12A, when the rotary valve 27 is rotated to the plus side, a strong tumble flow is generated that swirls into the combustion chamber 20 because the intake air tends to collect at the upper side in FIG. 12A within the intake port 21. In contrast, as shown in FIG. 12B, a tumble flow that swirls upward in the combustion chamber 20 is generated when the rotary valve 27 is rotated to the minus side, because the intake air tends to collect at the lower side in FIG. 12A within the intake port 21.

Figure 13:
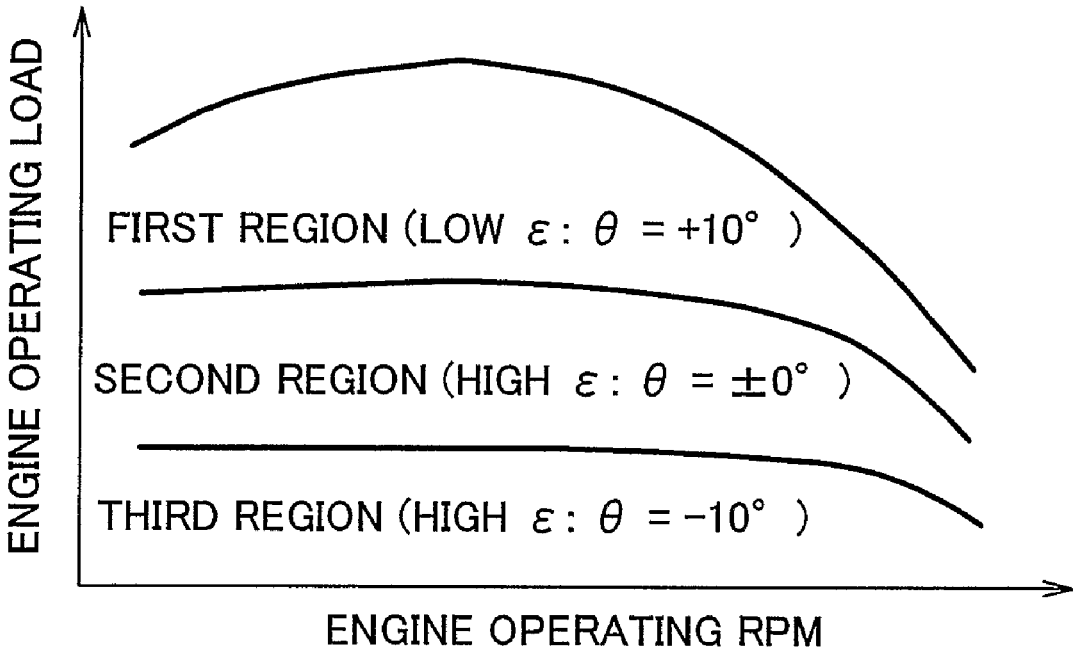
FIG. 13 is a drawing showing the relationship between the engine load and engine rpm of the internal combustion engine and the attitude of the rotary valve according to the third embodiment of the present invention.

As shown in FIG. 13, in this embodiment in the first region, in which the compression ratio is low, in a high-load operating condition, θ is +10°. In the second region, which has lower load than the first region and in which the compression ratio is high, θ is ±0°. Additionally, in the third region, in which the operating condition is such that the compression ratio is high and the load is lower than the second region, θ is −10°.

If this is done, in the first region, in which the load is high and the compression ratio is low, as shown in FIG. 12A a tumble flow is generated that is pulled into the combustion chamber 20, and it is possible to generate a strong, high-volume tumble flow. By doing this, even when the height of the combustion chamber is increased at a low compression ratio, it is possible to generate a strong tumble flow and to stabilize the condition of combustion.

In the third region, which is the condition in which the compression ratio is low at a low load, the rotational angle θ of the rotary valve 27 is on the opposite side from the first region, a tumble flow is generated that swirls upward, as shown in FIG. 12B, and it is possible to form an air current along the sloping surface of the piston 15 to assist lean combustion.

In this manner, this embodiment has the rotary valve 27 in the intake port 21, and by controlling the attitude of the rotary valve 27 in accordance with the compression ratio (operating condition), it is possible to generate tumble flow not only when the compression ratio is low, but also when the compression ratio is high. It is therefore possible to stabilize the condition of combustion regardless of the compression ratio. Specifically, it is possible to suppress a reduction in speed of combustion and unstable combustion when the compression ratio is low and it becomes difficult to generate tumble flow in the combustion chamber 20, and it is also possible to suppress unstable combustion due to decreased thermal efficiency at a high compression ratio because of a high S/V ratio. In addition to the foregoing, the rotational angle of the rotary valve 27 may be controlled to the optimum angle determined experimentally in response to the amount of air flow.

Figure 14:
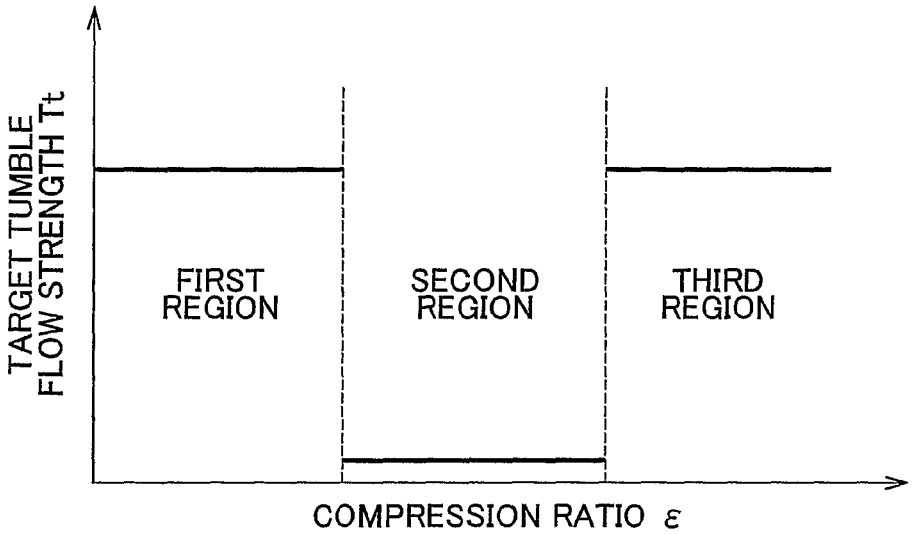
FIG. 14 is a drawing showing the relationship between the compression ratio and the target tumble flow strength according to the third embodiment of the present invention.

FIG. 14 is a graph showing the relationship between the compression ratio and the target tumble flow strength Tt in the above-noted control. Although the direction of tumble flow differs between the first region and the third region, it can be seen that the target tumble flow strength Tt is greater than in the second region. In FIG 14, the compression ratio at the boundary between the first and second regions corresponds to the third compression ratio in this embodiment, and the compression ratio at the boundary between the second and third regions corresponds to the fourth compression ratio in this embodiment.

Figure 15:
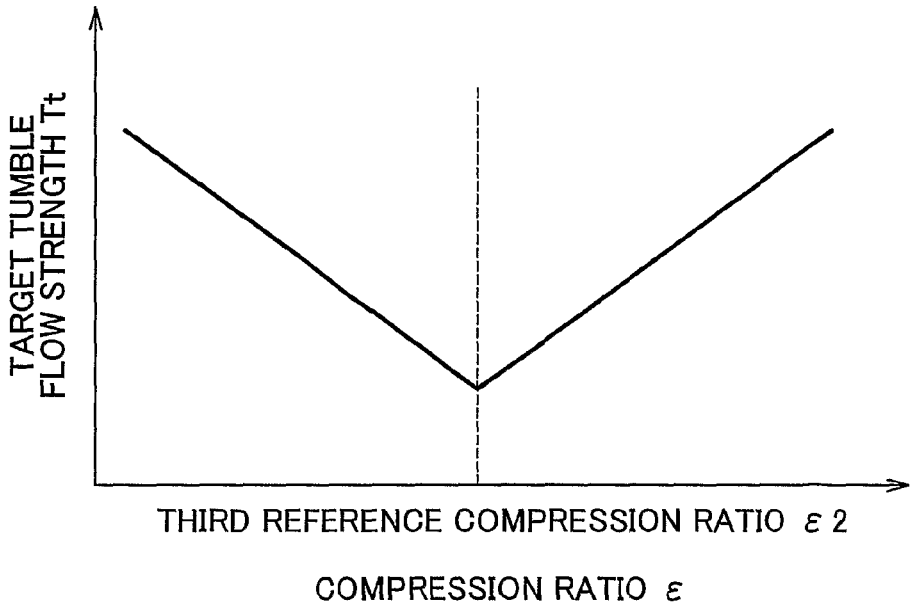
FIG. 15 is a drawing showing another example of the relationship between the compression ratio and the target tumble flow strength according to the third embodiment of the present invention.

The relationship between the compression ratio and the target tumble flow strength Tt is not restricted to the relationship shown in FIG. 14. For example, as shown in FIG. 15, when the compression ratio is a third prescribed reference compression ratio ϵ2 or lower, the target tumble flow strength Tt may be increased, the lower the compression ratio becomes relative thereto, and at the same time when the compression ratio is greater than the third prescribed reference compression ratio ϵ2, the target tumble flow Tt may be increased, the higher the compression ratio becomes relative thereto. By doing this, it is possible to control the tumble flow strength Tt to an appropriate value in accordance with the compression ratio for the cases of both low and high compression ratios, enabling more reliable stabilization of the condition of combustion, regardless of the compression ratio. The third reference compression ratio ϵ2 in this case corresponds to both the fifth compression ratio and the sixth compression ratio in this embodiment. In the first region of compression ratio shown in FIG. 14, the target tumble flow strength Tt may be increased the lower the compression ratio is, and in the third compression ratio region of FIG. 14, the target tumble flow strength may be increased the higher the compression ratio is. In this case, the compression ratio at the boundary between the first region and the second region corresponds to the fifth compression ratio in this embodiment, and the compression ratio at the boundary between the second region and the third region corresponds to the sixth compression ratio in this embodiment.

Figure 16A:
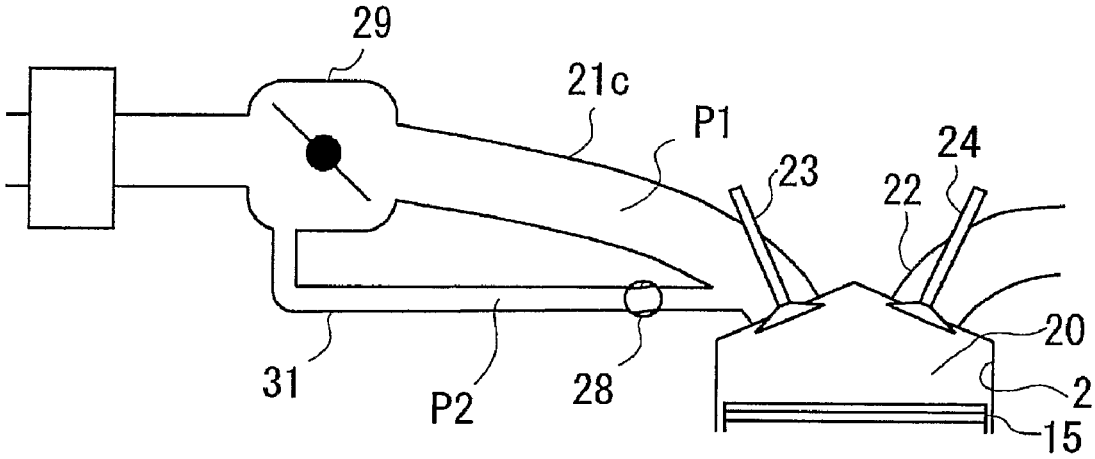
FIG. 16A and FIG. 16B are drawings showing details of another example of the vicinity of the combustion chamber according to the third embodiment of the present invention.
Figure 16B:
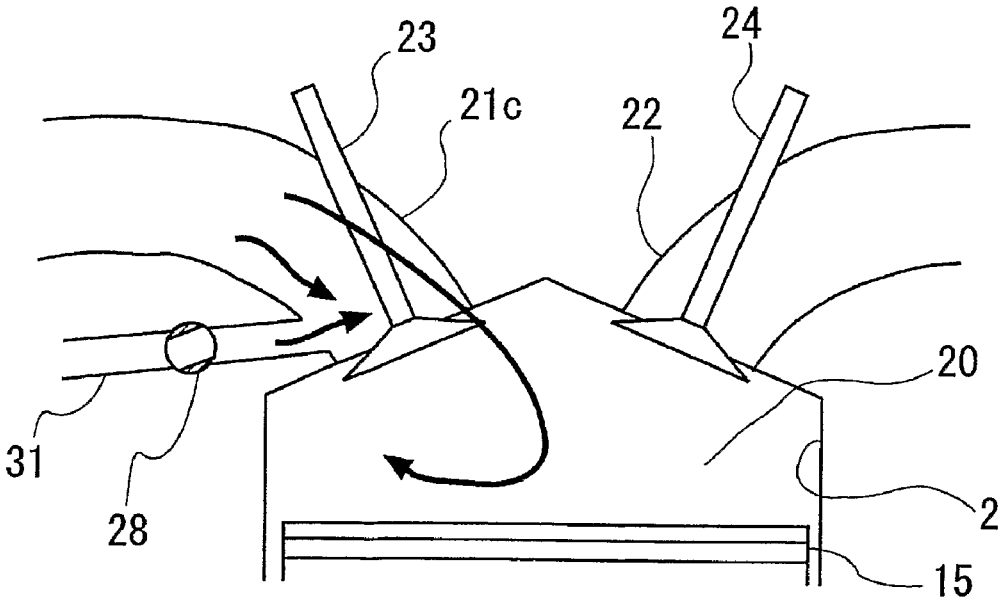

Another variation of this embodiment will now be described. FIG. 16A shows the details of the vicinity of the combustion chamber 20 in this embodiment. As shown in FIG. 16A, this form of the embodiment has, in addition to an intake port 21*c*, an auxiliary intake passage 31. An auxiliary valve 28 is rotatably provided in the auxiliary intake passage 31. The auxiliary intake passage 31 guides air from upstream of the main throttle 29 on the upstream side of the intake port 21*c*. Using the fact that the pressure P2 in the auxiliary intake passage 31 is higher than the pressure P1 in the intake port 21*c*, a strong target tumble flow is generated. When this is done, as shown in FIG 16B, by controlling the direction of the air flow ejected from the auxiliary intake passage 31 by using the auxiliary valve 28, the direction and strength of the tumble flow flowing into the combustion chamber 20 are controlled.

In this embodiment, when the main throttle 29 is fully opened and there is no great difference between the pressure P1 at the intake port 21*c* and the pressure P2 in the auxiliary intake passage 31, it is difficult to generate a tumble flow, however, pulsation generated inside the intake port 21*c* may be used. That is, the auxiliary valve 28 may be rotated to adjust the phase of the opening of the auxiliary valve 28 to the timing at which the pulsation inside the intake port 21*c* makes P2 greater than P1.

In the foregoing embodiment, although the description is for the example in which, in response to the compression ratio of the internal combustion engine 1, and in particular in the conditions in which the compression ratio is low and high, the tumble flow strength in the combustion chamber is increased, the swirl flow in the combustion chamber may also be strengthened to suit the strength of the tumble flow.

The invention claimed is:

1. A variable compression ratio internal combustion engine, comprising:

a variable compression ratio mechanism that changes a volume in a combustion chamber of the internal combustion engine in the axial direction of a cylinder by changing a relative position between a cylinder head and a piston of the internal combustion engine when the piston is positioned at a top dead center to control a compression ratio of the internal combustion engine; and a tumble flow strength controller that controls a strength of tumble flow in the combustion chamber, wherein a squish area is formed between the cylinder head and the piston in accordance with a height of the combustion chamber, the tumble flow strength controller controls the strength of the tumble flow in the combustion chamber according to the compression ratio controlled by the variable compression ratio mechanism, and the tumble flow strength controller increases the strength of the tumble flow as the compression ratio decreases.

2. A variable compression ratio internal combustion engine, comprising:

a variable compression ratio mechanism that changes a volume in a combustion chamber of the internal combustion engine in the axial direction of a cylinder by changing a relative position between a cylinder head and a piston of the internal combustion engine when the piston is positioned at a top dead center to control a compression ratio of the internal combustion engine; and a tumble flow strength controller that controls a strength of tumble flow in the combustion chamber, wherein a squish area is formed between the cylinder head and the piston in accordance with a height of the combustion chamber, the tumble flow strength controller controls the strength of the tumble flow in the combustion chamber according to the compression ratio controlled by the variable compression ratio mechanism, and the tumble flow strength controller strengthens the tumble flow if the compression ratio is below a prescribed compression ratio.

3. A variable compression ratio internal combustion engine, comprising:

a variable compression ratio mechanism that changes a volume in a combustion chamber of the internal combustion engine in the axial direction of a cylinder by changing a relative position between a cylinder head and a piston of the internal combustion engine when the piston is positioned at a top dead center to control a compression ratio of the internal combustion engine; and a tumble flow strength controller that controls a strength of tumble flow in the combustion chamber, wherein a squish area is formed between the cylinder head and the piston in accordance with a height of the combustion chamber, the tumble flow strength controller controls the strength of the tumble flow in the combustion chamber according to the compression ratio controlled by the variable compression ratio mechanism, and the tumble flow strength controller strengthens the tumble flow if the compression ratio is below a prescribed compression ratio and an engine load of the internal combustion engine is below a prescribed load.

4. A variable compression ratio internal combustion engine, comprising:

a variable compression ratio mechanism that changes a volume in a combustion chamber of the internal combustion engine in the axial direction of a cylinder by changing a relative position between a cylinder head and a piston of the internal combustion engine when the piston is positioned at a top dead center to control a compression ratio of the internal combustion engine; and a tumble flow strength controller that controls a strength of tumble flow in the combustion chamber, wherein a squish area is formed between the cylinder head and the piston in accordance with a height of the combustion chamber, the tumble flow strength controller controls the strength of the tumble flow in the combustion chamber according to the compression ratio controlled by the variable compression ratio mechanism, and the tumble flow strength controller strengthens the tumble flow if the compression ratio is below a prescribed compression ratio or if the compression ratio is above a further prescribed compression ratio.

5. A variable compression ratio internal combustion engine, comprising:

a variable compression ratio mechanism that changes a volume in a combustion chamber of the internal combustion engine in the axial direction of a cylinder by changing a relative position between a cylinder head and a piston of the internal combustion engine when the piston is positioned at a top dead center to control a compression ratio of the internal combustion engine; and a tumble flow strength controller that controls a strength of tumble flow in the combustion chamber, wherein a squish area is formed between the cylinder head and the piston in accordance with a height of the combustion chamber, the tumble flow strength controller controls the strength of the tumble flow in the combustion chamber according to the compression ratio controlled by the variable compression ratio mechanism, and if the compression ratio is below a prescribed compression ratio, the tumble flow controller increases the strength of the tumble flow as the compression ratio decreases, and if the compression ratio is above a further prescribed compression ratio, the tumble flow controller increases the strength of the tumble flow as the compression ratio increases.

6. The variable compression ratio internal combustion engine according to claim 1, wherein the tumble flow strength controller changes the strength of the tumble flow by switching an opening and closing of a tumble control valve disposed within the intake port of the internal combustion engine.

7. The variable compression ratio internal combustion engine according to claim 1, wherein the tumble flow strength controller changes the strength of the tumble flow by changing the timing of the opening of an intake valve during an intake stroke of the internal combustion engine.

8. The variable compression ratio internal combustion engine according to claim 1, wherein the axial cross-sectional shape of an intake port of the internal combustion engine is established so that the width of the cross-section of the intake port is greater toward the center of the combustion chamber than toward the periphery of the combustion chamber.

9. The variable compression ratio internal combustion engine according to claim 1, wherein concave and convex portions are formed in the uppermost surface of the piston of the internal combustion engine to promote generation of the tumble flow.

10. The variable compression ratio internal combustion engine according to claim 1, wherein when the intake valve of the internal combustion engine is opened, the outer peripheral side vicinity of the intake port with respect to the cylinder axis is narrower in space with the intake valve than the inner peripheral side of the intake port with respect to the cylinder axis.

11. The variable compression ratio internal combustion engine according to claim 1, wherein the tumble flow strength controller includes an auxiliary intake passage that opens in the vicinity of the inlet of the intake port to bypass the intake port from upstream of a throttle valve of the internal combustion engine, and an auxiliary valve provided in the auxiliary intake passage, wherein the auxiliary valve controls a direction of air flow ejected from the auxiliary intake passage to control a direction and strength of the tumble flow flowing into the combustion chamber.

12. The variable compression ratio internal combustion engine according to claim 2, wherein the tumble flow strength controller changes the strength of the tumble flow by switching an opening and closing of a tumble control valve disposed within the intake port of the internal combustion engine.

13. The variable compression ratio internal combustion engine according to claim 2, wherein the tumble flow strength controller changes the strength of the tumble flow by changing the timing of the opening of an intake valve during an intake stroke of the internal combustion engine.

14. The variable compression ratio internal combustion engine according to claim 2, wherein the axial cross-sectional shape of an intake port of the internal combustion engine is established so that the width of the cross-section of the intake port is greater toward the center of the combustion chamber than toward the periphery of the combustion chamber.

15. The variable compression ratio internal combustion engine according to claim 2, wherein concave and convex portions are formed in the uppermost surface of the piston of the internal combustion engine to promote generation of the tumble flow.

16. The variable compression ratio internal combustion engine according to claim 2, wherein when the intake valve of the internal combustion engine is opened, the outer peripheral side vicinity of the intake port with respect to the cylinder axis is narrower in space with the intake valve than the inner peripheral side of the intake port with respect to the cylinder axis.

17. The variable compression ratio internal combustion engine according to claim 2, wherein the tumble flow strength controller includes an auxiliary intake passage that opens in the vicinity of the inlet of the intake port to bypass the intake port from upstream of a throttle valve of the internal combustion engine, and an auxiliary valve provided in the auxiliary intake passage, wherein the auxiliary valve controls a direction of air flow ejected from the auxiliary intake passage to control a direction and strength of the tumble flow flowing into the combustion chamber.

18. The variable compression ratio internal combustion engine according to claim 3, wherein the tumble flow strength controller changes the strength of the tumble flow by switching an opening and closing of a tumble control valve disposed within the intake port of the internal combustion engine.

19. The variable compression ratio internal combustion engine according to claim 3, wherein the tumble flow strength controller changes the strength of the tumble flow by changing the timing of the opening of an intake valve during an intake stroke of the internal combustion engine.

20. The variable compression ratio internal combustion engine according to claim 3, wherein the axial cross-sectional shape of an intake port of the internal combustion engine is established so that the width of the cross-section of the intake port is greater toward the center of the combustion chamber than toward the periphery of the combustion chamber.

21. The variable compression ratio internal combustion engine according to claim 3, wherein concave and convex portions are formed in the uppermost surface of the piston of the internal combustion engine to promote generation of the tumble flow.

22. The variable compression ratio internal combustion engine according to claim 3, wherein when the intake valve of the internal combustion engine is opened, the outer peripheral side vicinity of the intake port with respect to the cylinder axis is narrower in space with the intake valve than the inner peripheral side of the intake port with respect to the cylinder axis.

23. The variable compression ratio internal combustion engine according to claim 3, wherein the tumble flow strength controller includes an auxiliary intake passage that opens in the vicinity of the inlet of the intake port to bypass the intake port from upstream of a throttle valve of the internal combustion engine, and an auxiliary valve provided in the auxiliary intake passage, wherein the auxiliary valve controls a direction of air flow ejected from the auxiliary intake passage to control a direction and strength of the tumble flow flowing into the combustion chamber.

24. The variable compression ratio internal combustion engine according to claim 4, wherein the tumble flow strength controller changes the strength of the tumble flow by switching an opening and closing of a tumble control valve disposed within the intake port of the internal combustion engine.

25. The variable compression ratio internal combustion engine according to claim 4, wherein the tumble flow strength controller changes the strength of the tumble flow by changing the timing of the opening of an intake valve during an intake stroke of the internal combustion engine.

26. The variable compression ratio internal combustion engine according to claim 4, wherein the axial cross-sectional shape of an intake port of the internal combustion engine is established so that the width of the cross-section of the intake port is greater toward the center of the combustion chamber than toward the periphery of the combustion chamber.

27. The variable compression ratio internal combustion engine according to claim 4, wherein concave and convex portions are formed in the uppermost surface of the piston of the internal combustion engine to promote generation of the tumble flow.

28. The variable compression ratio internal combustion engine according to claim 4, wherein when the intake valve of the internal combustion engine is opened, the outer peripheral side vicinity of the intake port with respect to the cylinder axis is narrower in space with the intake valve than the inner peripheral side of the intake port with respect to the cylinder axis.

29. The variable compression ratio internal combustion engine according to claim 4, wherein the tumble flow strength controller includes an auxiliary intake passage that opens in the vicinity of the inlet of the intake port to bypass the intake port from upstream of a throttle valve of the internal combustion engine, and an auxiliary valve provided in the auxiliary intake passage, and the auxiliary valve controls a direction of air flow ejected from the auxiliary intake passage to control a direction and strength of the tumble flow flowing into the combustion chamber.

30. The variable compression ratio internal combustion engine according to claim 5, wherein the tumble flow strength controller changes the strength of the tumble flow by switching an opening and closing of a tumble control valve disposed within the intake port of the internal combustion engine.

31. The variable compression ratio internal combustion engine according to claim 5, wherein the tumble flow strength controller changes the strength of the tumble flow by changing the timing of the opening of an intake valve during an intake stroke of the internal combustion engine.

32. The variable compression ratio internal combustion engine according to claim 5, wherein the axial cross-sectional shape of an intake port of the internal combustion engine is established so that the width of the cross-section of the intake port is greater toward the center of the combustion chamber than toward the periphery of the combustion chamber.

33. The variable compression ratio internal combustion engine according to claim 5, wherein concave and convex portions are formed in the uppermost surface of the piston of the internal combustion engine to promote generation of the tumble flow.

34. The variable compression ratio internal combustion engine according to claim 5, wherein when the intake valve of the internal combustion engine is opened, the outer peripheral side vicinity of the intake port with respect to the cylinder axis is narrower in space with the intake valve than the inner peripheral side of the intake port with respect to the cylinder axis.

35. The variable compression ratio internal combustion engine according to claim 5, wherein the tumble flow strength controller includes an auxiliary intake passage that opens in the vicinity of the inlet of the intake port to bypass the intake port from upstream of a throttle valve of the internal combustion engine, and an auxiliary valve provided in the auxiliary intake passage, wherein the auxiliary valve controls a direction of air flow ejected from the auxiliary intake passage to control a direction and strength of the tumble flow flowing into the combustion chamber.

* * * * *